US006675842B1

(12) United States Patent
Fitter

(10) Patent No.: US 6,675,842 B1
(45) Date of Patent: Jan. 13, 2004

(54) FLUID DELIVERY SYSTEM

(76) Inventor: Johan C. Fitter, P.O. Box 67080, Byranston 2021 (ZA)

( * ) Notice: Subject to any disclaimer, the term of this patent is extended or adjusted under 35 U.S.C. 154(b) by 0 days.

(21) Appl. No.: 10/157,722

(22) Filed: May 28, 2002

(51) Int. Cl.[7] ..... B65B 1/04

(52) U.S. Cl. ..... 141/114; 141/198; 141/95; 141/32

(58) Field of Search ..... 141/1.1, 32, 67, 141/2, 18, 114, 198, 95; 251/6, 7, 9; 604/407–409, 411, 414, 416

(56) References Cited

U.S. PATENT DOCUMENTS

| | | | | | |
|---|---|---|---|---|---|
| 3,189,063 | A | * | 6/1965 | Lowe | 141/199 |
| 3,696,969 | A | | 10/1972 | De Van et al. | |
| 4,261,388 | A | * | 4/1981 | Shelton | 137/486 |
| 4,397,642 | A | * | 8/1983 | Lamadrid | 604/245 |
| 4,544,004 | A | | 10/1985 | Fitter et al. | |
| 4,829,002 | A | * | 5/1989 | Pattillo et al. | 435/297.1 |
| 4,905,875 | A | | 3/1990 | Straiton | |
| 5,188,620 | A | * | 2/1993 | Jepson et al. | 604/534 |
| 6,164,309 | A | | 12/2000 | Brecht | |
| 6,341,628 | B1 | | 1/2002 | Burson | |
| 6,427,732 | B1 | * | 8/2002 | Fitter | 141/95 |
| 6,446,681 | B1 | | 9/2002 | Fitter | |
| 6,554,025 | B1 | | 4/2003 | Fitter | |
| 2002/0038765 | A1 | | 4/2002 | Fitter | |
| 2002/0051912 | A1 | | 5/2002 | Fitter et al. | |
| 2002/0102467 | A1 | | 8/2002 | Fitter | |

* cited by examiner

*Primary Examiner*—Steven O. Douglas
(74) *Attorney, Agent, or Firm*—William J. Sapone; Coleman Sudol Sapone, P.C.

(57) ABSTRACT

A fluid dispensing system has a flexible bag filled with a dispensable material, a dispensing opening adjacent a receiving socket, the dispensing opening including a push valve. A dispensing coupling is removably located in the receiving socket and has an actuating end which engages the push valve to initiate flow. A flow regulator is incorporated with the dispensing conduit for controlling the flow of the material from the bag.

15 Claims, 5 Drawing Sheets

FLUID DELIVERY SYSTEM

TECHNICAL FIELD

This invention relates to a method and apparatus for delivering fluids from a disposable container with flow control to avoid spillage.

BACKGROUND

Fluid delivery systems have been in use since ancient times. It was not uncommon for cities of old to arrange a water reservoir some distance from the city, for example, in nearby foothills, and to convey the water for use in the city via aqueducts, to the points of consumption, by gravity.

Today, in many applications, the basic principles of long ago are still in use. For example, household and industrial water is often stored in reservoirs, often referred to as "head" tanks positioned above the points of application, being piped to a point of delivery under gravity, with the flow being controlled by valves, taps or faucets.

In more modestly sized applications, such as in industrial fluid delivery systems, specialized fluid delivery systems are commonly employed to provide delivery of a variety of fluids in addition to water, such as oils, chemicals, and the like.

There are also relatively small fluid delivery systems, such as used in restaurants or in catering, for delivering small quantities of fluids such as used to dispense condiments such as ketchup, though gravity delivery of more viscous materials is often unsuccessful with gravity alone. Most often such fluid dispensers rely on various pumps for dispensing these products in small dosage amounts.

In such applications, the fluid reservoirs may be made of flexible impermeable sheeting or polymer film, which can be shaped into a bag-like or bladder-like structure. Such a flexible bag or bladder can take a convenient shape permitted by its surroundings, without detrimentally affecting its fluid retaining capacity. Generally, for safe transport without puncturing or tearing flexible container, the container is typically placed in a suitable housing, such as for example, a cardboard carton, and the like. A typical example would be an inexpensive wine container, where wine is delivered in a bladder in a cardboard carton, with an on/off valve for dispensing the wine to smaller containers or glasses.

Flexible reservoirs or containers possess some significant advantages over rigid types. For example, a water-filled pouch constructed out of a flexible sheet polymer is resistant to some extent to damage. For example, such a pouch is unlikely to rupture on falling from a typical worktop or get counter height, whereas a rigid container made of glass, rigid plastic and even metal, may fail on impact. Also, the flow from a rigid container can be disrupted if adequate provision is not made to allow air to enter into the container to replace void volume created by the dispensed fluid. In such a case, for example where the air intake becomes blocked, the flow will simply stop. A flexible container needs no such make-up air. Being flexible, the container simply contracts in correspondence to the volume of fluid dispensed. Flexible containers are also usually lighter and less expensive than their rigid counterparts, and provide better recycling opportunities.

There are however some disadvantages to the use of flexible containers. One difficulty which has limited the use of such containers is that too often, upon making an opening in a flexible container, the act of handling necessary to set-up or dispense fluids causes uncontrolled ejection of at least a portion of the fluid contents. Attempts have been made to address this problem, with varying degrees of success. In one attempt, a sealing film is placed over a fluid dispensing duct having a dispensing aperture. In use, the sealing film is pierced by insertion of a piercing plug into the aperture. This type of connection is typically used in for intravenous infusion of liquids and medicament, also known as IV or drip bags. Unfortunately, in such a case, the aperture cannot be resealed and remains open after use.

The incorporation of a manually operated control valve in place of the pierceable film provides better fluid control. One example as discussed previously is found in the "boxed" wine form of packaging, where a dispensing on/off valve is used. While this form of control under direct manual operation is adaptable to certain applications, it cannot be used in more complex delivery systems, for example where the fluid is dispensed intermittently over time and it would be impractical for someone to simply stand by the valve to dispense liquid on command. There is also the disadvantage which exists with any manually operated shut off system, which is that the valve can be left open through inattention, or be inadvertently opened, releasing the fluid.

An IV type of flexible container is usually has a length of narrow bore tubing, having a valve arrangement suitable for attachment to such fluid conduits. The tubing facilitates dispensing the fluid at its distal end. With such an arrangement, the risk of spillage is greatest at the conclusion of the fluid delivery procedure. Any residual fluid may be released when the tubing is disconnected from the flexible container.

This problem is exacerbated when flow monitoring and/or additional control valves are included in-line with the fluid conduit at the distal point, since it can be erroneously assumed that since the flow has stopped, the flexible container is empty

SUMMARY OF THE INVENTION

It is an object of the present invention to provide a fluid dispensing system which overcomes the disadvantages of the prior art.

It is another object to provide a fluid delivery system which can uses a flexible container, yet which allows for unsupervised fluid dispensing.

It is another object to provide a fluid delivery system which reduces or eliminates spillage when disconnecting a delivery tube from the fluid container.

These and other objects of the present invention are achieved by a system for filling a container comprising a flexible bag containing a dispensable material therein, the bag having a dispensing opening having means for communicating with a dispensing conduit, a dispensing coupling for removable placement in the receiving means and connected to the dispensing conduit, and a flow regulator for regulating material flow from the flexible bag to the container through the dispensing conduit to the container.

Preferably, the receiving means is a socket, the dispensing opening having a push type of valve for preventing fluid flow during transport and storage of the bag. The dispensing coupling is then first received by the socket, to form a seal, further insertion of the coupling engaging the push valve to initiate fluid flow.

Using the present invention, virtual leak-free dispensing of fluids is achieved and discontinuance as well can be undertaken with a limited loss of fluid as the push valve is closed prior to the coupling leaving the socket.

DETAILED DESCRIPTION OF THE INVENTION

Figure 1:
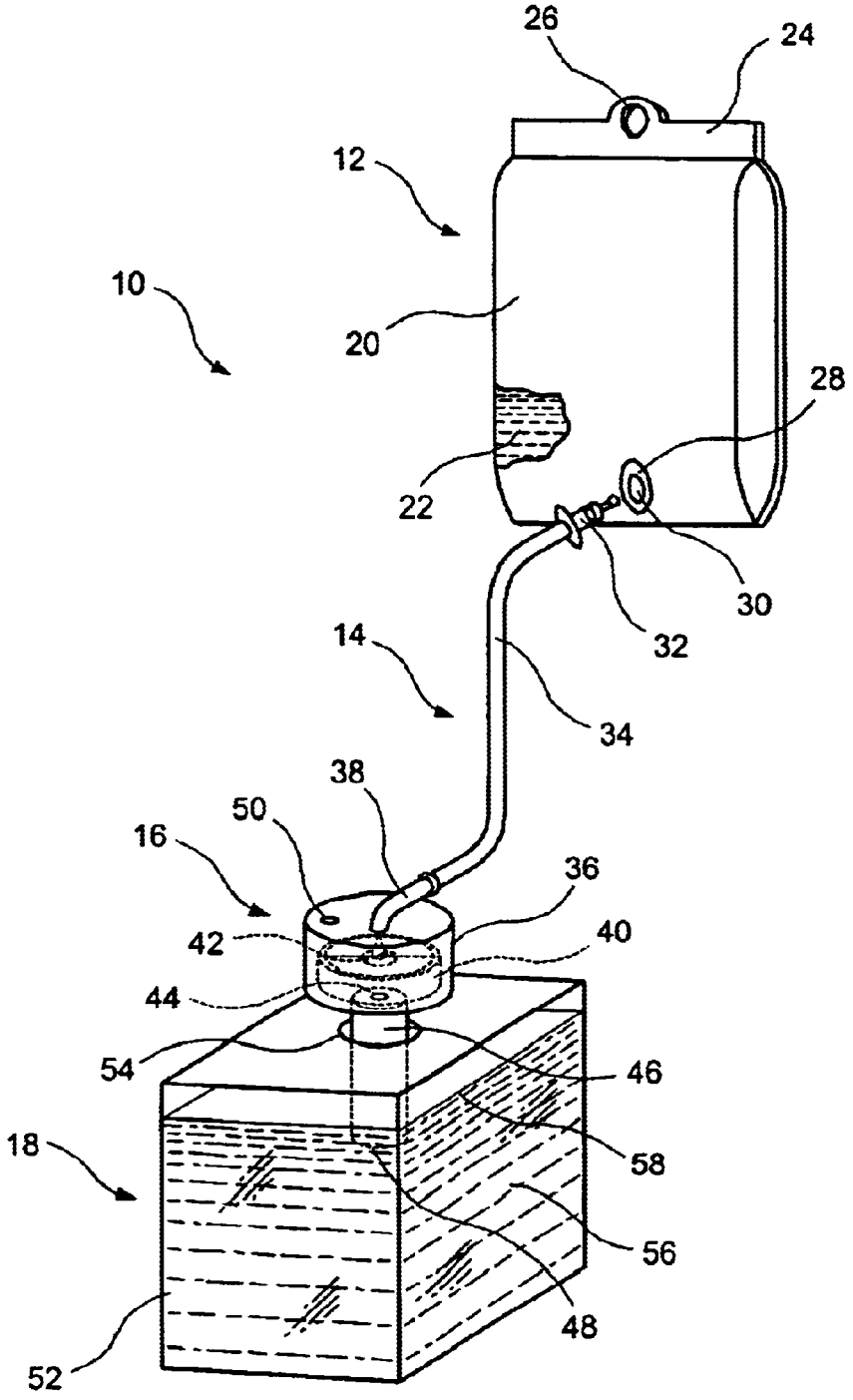
FIG. 1 shows a fluid delivery system in accordance with the present invention.

Referring to FIG. 1, a fluid delivery system 10 has a fluid source 12, a fluid conveying conduit 14, a flow regulator 16 and a fluid receiver 18. The fluid delivery system 10 is intended in use to establish an impermanent fluid flow path between the source 12 and the receiver 18.

The fluid source 12 is a flexible container 20, which may also be termed a "bag" or "bladder". "Flexible" for terms of this application means a container is composed of a material which allows the container to substantially reduce its shape in conformance to the discharge of fluid therefrom. Various plastics, paper, metal foil constructions and laminates may be used to produce the flexible container. The container 20 is precharged with a dispensable material, for example, a fluid 22 which, as shown in FIG. 1, causes the container 20 to acquire a rounded appearance. The bag 20 may be suspended by means of an integral suspension member 24 equipped with an aperture 26, engaged by a rack or other hanging device (not shown). Alternatively, the container 20 may be supported on a shelf or by any other means adequate to position the container for gravity feed of the fluid contained therein, if no means for pressurizing, pumping or vacuum drawing of the fluid are used. In this embodiment, gravity feed is described as this is likely the most common delivery system, as well as likely the most reliable since it is a simple dispensing system.

The bag 20 is equipped with an integral coupling socket 28 having an access aperture 30. In this embodiment, the fluid conveying conduit 14 is connected to a coupling plug 32, the conveying conduit 14 being a length of flexible tubing 34. The coupling plug 34 is attached to a first end of the tubing 34. A delivery end of the tubing 34 is attached to the flow regulator 16. The attachment at the delivery end may optionally utilize various connecting or coupling means, clamps, etc. not shown, or there could simply be a frictional slip fit, depending on the operational requirements.

The flow regulator 16 shown in FIG. 1 is based on an internal float principle which uses a float to control flow to the fluid receiver 18 while preventing contact between the delicate float/valve mechanism, and any pre-existing contents of the fluid receiver 18.

Referring still to FIG. 1, the flow regulating device comprises a vessel 36, a tubular valve seat assembly 38, a float 40, a valve member 42, an exit aperture 44, and a level sensor 46 which here comprises an air compression tube with an open end 48, the combination of valve components, float and level sensor constituting an example of a level controlled flow shut-off activator. A small air vent 50 is also provided to allow air entry or removal in response to changes in the liquid level within the vessel.

The fluid receiver 18 is shown as consisting of a simple rectangular receptacle 52. This of course represents only one example among many types of fluid receiving devices which may benefit from the present invention. In this embodiment, rather than direct dispensing, the fluid delivery system is used to deliver the fluid to the receptacle. The receptacle here contains a resident material 56 which may be solid, liquid, gel etc. The resident material may be permanently or impermanently retained by the receptacle 52. In this example, the resident material 56 is to be maintained at or near a level 58, and an opening 54 is provided for allowing fluid to enter the receptacle. Of course, the fluid delivery system could be used to place the fluid in an empty receptacle, as well as to add make-up amounts to satisfy the level requirements.

One example of a use for the fluid delivery system is where the receptacle is a lead-acid battery. In such a case, the battery casing already contains as the retainable material 56 a sulfuric acid electrolyte, with the fluid to be delivered generally comprising purified water.

In another example, the receptacle 52 comprises a food processing container, and the resident material 56 consists of a quantity of dehydrated food. The fluid 22 would then be water or a mixture of water and oil, that may include other ingredients, for flavor enhancement, etc. In a further example, the receptacle 52 comprises a cooking pan, and the resident material 56 consists of a hamburger patty. The fluid 22 may be a condiment such as tomato ketchup. In this latter example, the flow regulator 16 would typically consist of a nozzle device with manual on-off control. In yet another example, the receptacle 52 could comprise a laundry tub, the resident material 56 being articles of clothing, and the fluid 22 being liquid, powder or gel detergent, fabric softener, etc. The invention has diverse uses, for example, where a resident material receives a dispensable material or generally wherever fluid dispensing with limited spillage from a flexible container is contemplated. Thus, these examples have been provided for illustration, and in no way limit the invention to these particular applications, as the present invention is adaptable to many other applications.

The apparatus depicted in FIG. 1 is therefore illustrative and used to explain the principles of operation of a fluid delivery system according to the invention, and in no way should be construed as implying any limitation on the scope of the invention.

In FIG. 1, the fluid source 12 consists of a polymer sheeting or plastic film bag 20 containing water 22. The bag 20 is usually filled so as not to cause it to become fully distended. The bag 20 has an integral coupling socket 28, having an access aperture 30. The aperture 30 is normally maintained closed, and is normally opened by insertion into the aperture 30 of the coupling plug 32. When closed, the aperture 30 provides a barrier to flow of the fluid 22 from inside the bag 20 to the exterior. The bag 20 substantially contains the fluid 22, typically with little or no air. Air may be introduced during the course of operation of the fluid delivery system 10.

As described above, the fluid receiver 18 consists of a lead-acid secondary battery having a battery jar or case 52, containing sulfuric acid electrolyte 56. Positive and negative plates, also referred to as elements, have not been shown for ease in illustration, nor have the battery terminals, since they do not play any part in the operation of the fluid delivery system 10.

The flow regulator 16 can be based on a variety of designs suitable for effecting fluid shut-off and if required, flow regulation. One example, shown in FIG. 1, is a secondary battery water replenishment filler unit, similar to the type described in U.S. Pat. No. 4,544,004 to Fitter et al. Of course, other types of battery-filling devices may be used as well, including, by way of example, any type having an integral reservoir instead of a float-valve assembly, as well as types having a lever, a cam, a diaphragm, a duct, a weir and/or a spring, arranged as part of a level controlled flow shut-off activator.

When the coupling plug 32 is introduced into the access aperture 30 of the integral coupling socket 28, a portion of the fluid 22 contained in the bag 20 is able to flow into the tubing 34. The fluid is then available for admission into the vessel 36, in this case, when the quantity of the electrolyte 56 is below the level 58, and in particular, is lower than the open end 48 of the air compression tube 46. At that time, the float 40 will be resting on the base or floor of the vessel 36, the associated valve member 42 being away from the valve seat assembly 38. The portion of the fluid 22 in the tubing 34 thus flows into the vessel 36, slightly raising the float 40 so as to allow the leading portion of the fluid 22 to pass via the exit aperture 44, and to fall through the air compression tube 46, into the electrolyte 56.

As the leading portion of the fluid 22 exits the vessel 36, more of the fluid 22 is drawn into the tubing 34, so as to establish a continuous flow from the bag 20, into the battery case or receptacle 52. The admission of the fluid 22 increases the volume of the material 56, raising the level 58. Provided there is a sufficient volume of the fluid 22, the flow into the battery case or receptacle 52 will increase the level or the depth of the material 56 within the receptacle 52, so as to submerge the compression tube open end 48. When submerged, the open end 48 is sealed, thereby entrapping air inside the air compression tube 46. As more of the fluid 22 attempts to exit aperture 44, the air pressure within the air compression tube 46 will rise, thereby slowing the movement of the fluid 22 attempting to exit via the aperture 44, so as to cause further inflow of the fluid 22 into the electrolyte or material 56 to be halted, at the level 58 corresponding to a predetermined, desired level for the electrolyte 56 in the battery case.

The vessel 36 has an air equalization vent 56 to facilitate free movement of the float 40 according to the presence of a varying quantity of the fluid 22 within the vessel 36. A consequence of the stopping of the fluid flow is that continued inflow of the liquid 22 into the vessel 36 will now cause the float 40 to be lifted until the valve member 42 engages a tubular seat assembly 38, stopping the fluid flow through the length of tubing 34. The flow will stop regardless of any residual quantity of the fluid 22 still contained within the bag 20, and regardless of the position of the bag 20 relative to the receptacle 52, within practicable limits.

The coupling plug 32 and the socket 28 respectively, must be based on a design that will provide a requisite shut-off feature when separated from the bag 20. While various devices may be used, one example is shown in U.S. Pat. No. 6,126,045 to Last. The operation of the plug 32 and the socket 28 is illustrated in FIGS. 2, 3, 4 and 5, which in sequence show a typical engagement, and in reverse sequence show a typical disengagement.

Figure 2:
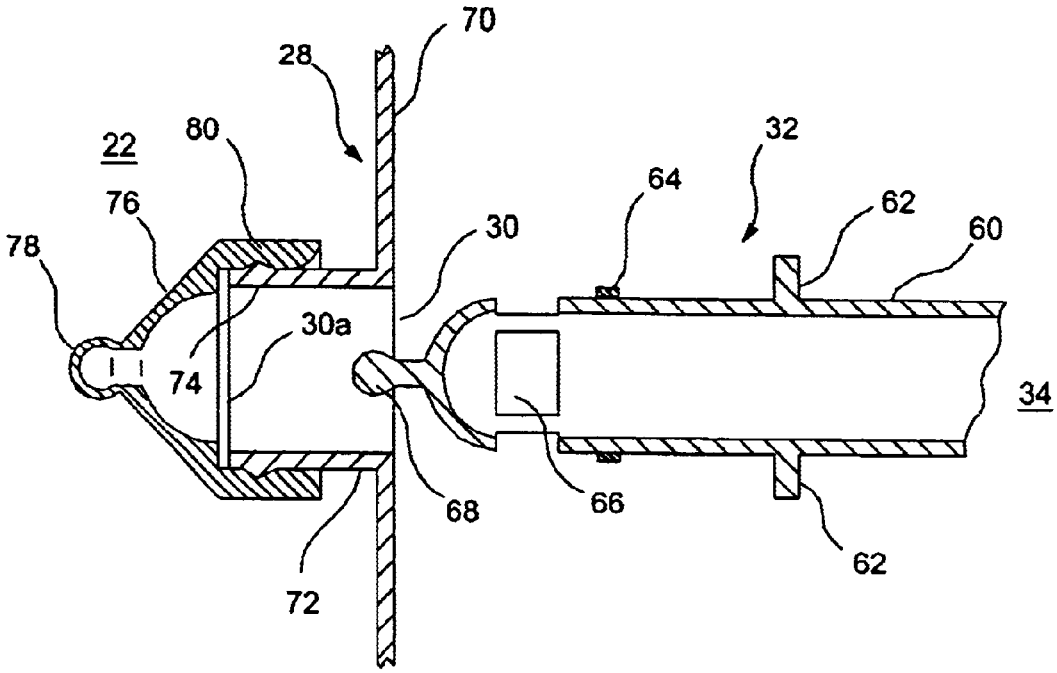
FIG. 2 is a detailed sectional schematic of a plug-in coupling shown in FIG. 1, prior to connection.

In FIG. 2, the plug 32 is about to enter the access aperture 30 of the socket 28. The socket 28 has a flange 70, which is typically heat sealed to the body of the bag 26, providing a fluid tight bond. The interior of the bag containing the fluid 22 is shown to the left of the flange 70.

The plug 32 has a hollow barrel 60, attached at the right to the length of tubing 34, (detail not shown). The barrel 60 has an insertion stop 62 and a rubber ring 64, circumferentially, one behind the other, as well as a blind end from which projects a round locking key 68, which is aligned with a receiving key hole 78 located well behind the flange 70. The barrel 60 is provided with a number of cutouts 66 about its circumference, close to the blind end and the locking key 68.

The socket 28 has an inwardly projecting passage 72, with the access aperture 30 on the right, and a closure cap 76 on the left, as shown. The closure cap 76 acts as a push-in type valve, which, while openable, has capacity positionally to engage in a condition of closure, effectively shutting off the opening 30*a* of the passage 72, so as to prevent any flow of the fluid 22 out of the bag 20 via the socket 28. The closure cap 76 is retained through a locking arrangement comprising a concentric groove 80, which is tightly held by a concentric ridge 74, so as to provide a seal thereby. The receiving key hole 78 lies at the center of the closure cap 76.

Figure 3:
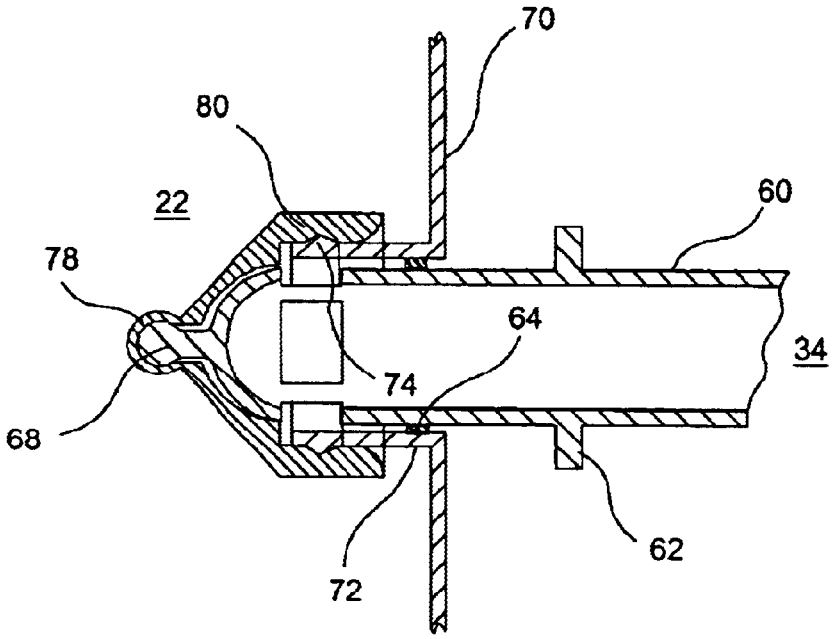
FIGS. 3, 4, and 5 show intermediate steps in the seating of the connector with a fluid container.

In FIG. 3, the plug 32 has been pushed part way into the aperture 30 of the socket 28, with the barrel 60 sliding into the passage 72 so as to cause the rubber ring 64 to become compressed and to fully occupy an annular space between the outer wall of the barrel 50 and the inner wall of the passage 72, effectively providing a seal at the position indicated by the ring annotation 64. The plug 32 has been pushed into the aperture 30 so far as to engage the key 68 in the keyhole 78. The groove 80 and the ridge 74 remain engaged, thereby retaining a fluid seal. Thus at this intermediate position of the plug 32 within the aperture 30, there are two fluid seals, one provided by the groove 80 and the ridge 74 preventing any flow from the bag 20 into the barrel 60 of the plug 32, and the other provided by the ring 64 preventing spillage of the fluid 22 through the plug 32.

Figure 4:
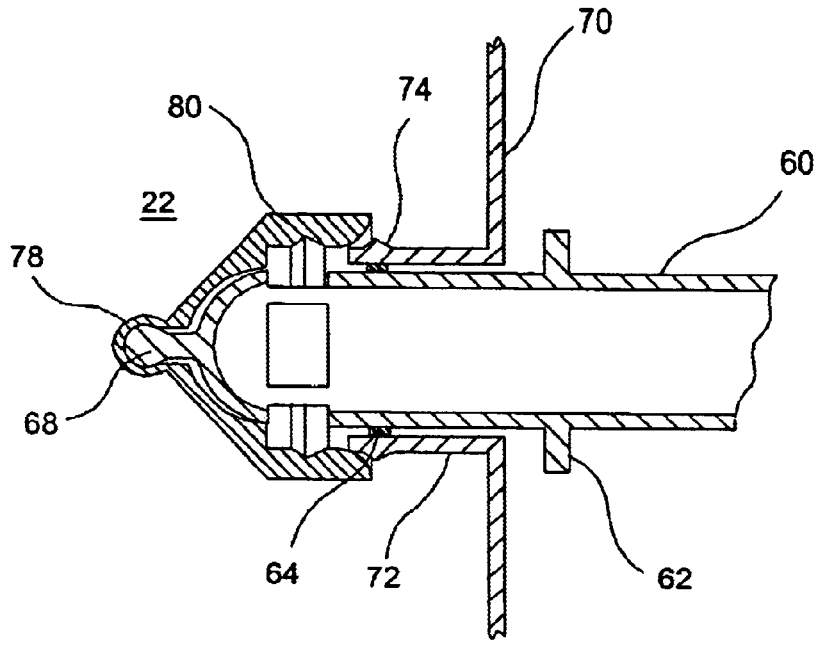

In FIG. 4, the plug 32 has been pushed farther into the aperture 30 of the socket 28, causing the groove 80 and the ridge 74 to become disengaged, eliminating the previous sealing engagement, yet retaining the seal provided by the ring 64 at the position indicated by the ring annotation 64. A tiny amount of fluid 22 may begin to flow out of the bag 20, into the barrel 66 via the disengaged groove 80 and ridge 74, and the cutouts 66.

Figure 5:
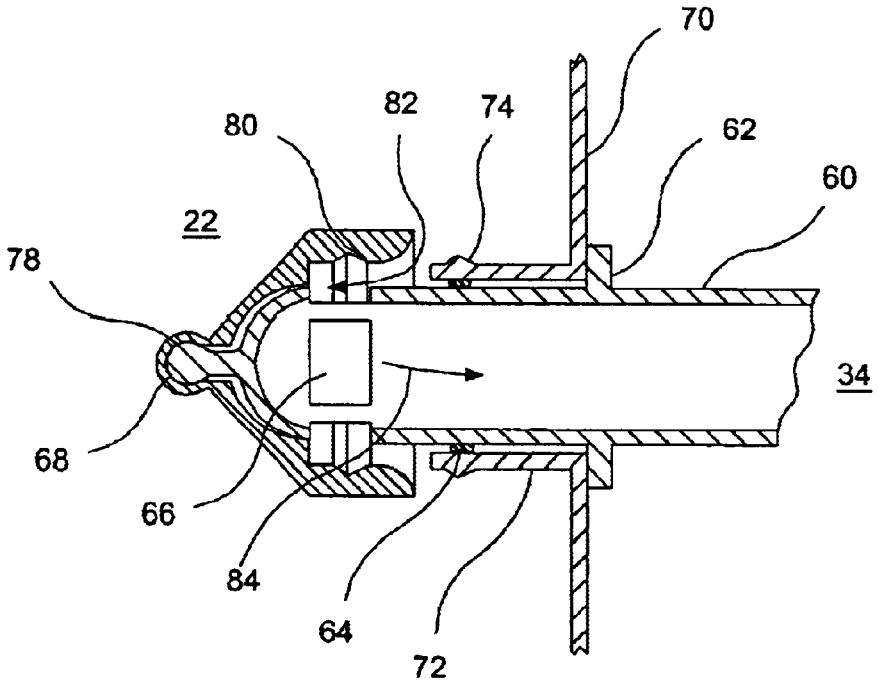

In FIG. 5, the plug 52 has been pushed fully home into the aperture 30 of the socket 28, bringing the insertion stop 62 against the flange 70, and spacing the groove 80 and the ridge 74 farthest apart. The ring 64 continues to maintain a seal, farther in, at the position indicated by the ring annotation 64. The fluid 22 is now able to flow out of the bag at a rate required by the application, along a flow path 82 and a continuation of this flow path 84 from within the bag 20, into the barrel 60 and hence into the length of tubing 34 shown in FIG. 1.

Importantly, withdrawal of the plug 32 from the aperture 30 of the socket 28 at any time whatsoever provides an exact reversal of the sequence of operation, as depicted from FIG. 5. to FIG. 2. Thus, to begin the fluid flow through the fluid delivery system 10, all that is required in for the plug 32 to be inserted into the aperture 30 of the socket 28, and for it to be pressed inward until the stop 62 engages the flange 70. To discontinue the fluid flow, the plug 32 is withdrawn from the socket 28, so that the closure cap 76 will reseat to prevent fluid from exiting the bag, before the plug is removed from the socket 28.

In a typical operation, the bag 20 containing a requisite quantity of the fluid 22 is procured, transported to the application site, where it may be hung from a supporting member by means of the aperture 26 in the suspension member 24. The plug 32 is inserted into the socket aperture 30, so as to initiate gravity flow through the delivery system.

As discussed above, the fluid receiver 18 can be a lead acid secondary battery, typically used with vehicles. In one example, one or more batteries used to propel a golf-car, require fluid itch replenishment. Each battery will likely comprise three, four or six individual cells according to vehicular requirements. While the illustration of the fluid delivery system 10 in FIG. 1 shows in essence a one cell battery, filling multiple cell batteries would not materially affect the operation of the fluid delivery system, other than requiring a greater quantity of fluid 22 to be provided. For a such a multicell battery, a multiple tubing splitting arrangement may be used, at the delivery end of the length of tubing 34, to divide the flow of the fluid 22 so as to provide a portion of the fluid 22 to each of the vehicular battery cells, in exactly the same way as the fluid delivery system 10 depicted in FIG. 1.

Alternatively, the flow regulating device 16 may be assigned a multiplicity of exit apertures 44 and level sensors 46 generally similar to the multiple container feed of U.S. Pat. No. 4,544,004, thereby facilitating delivery to more than one cell with minimal complexity.

Preferably, the length of tubing 34 with the plug 32 are housed within a vehicle battery compartment while the vehicle is in use. Periodically, the bag 20 is brought to the vehicle, the battery compartment is opened, the plug-end of the length of tubing 34 is withdrawn from the battery compartment, and the plug 32 is inserted into the aperture 30 of the socket 28. The plug 32 is pushed fully home, and the bag 20 is thereafter hung above the battery cells to permit gravity flow of the fluid 22 into the battery cells in receptacle 52. As each cell receives fluid 22, the electrolyte level rises to the desired level 58. The flow into the respective cells is stopped by the respective flow regulators 16, as described previously. Of course, cells may fill at different rates, and complete halt to the flow does not occur until all the level controlled flow shut-off activators have been run through to the concluding of their respective flows.

When the flow has stopped into all the vehicular battery cells, the bag 20 is preferably moved to a position lower than the flow regulators 16. This counter-acts and reverses the gravity effect, such that any residual fluid 22 residing in the length of tubing 34 may be returned to the bag 20. The plug 32 is then withdrawn from the socket aperture 30, the length of tubing 34 is stored in the battery compartment, and the bag 20 may be discarded if empty, or if there is any residual fluid, can be stored without spillage and used during a later fluid delivery operation. As discussed above, the fluid 22 is typically water, though the fluid delivery system is not so limited and may be used to deliver fresh electrolyte, or various additives useful for battery operation.

Figure 6:
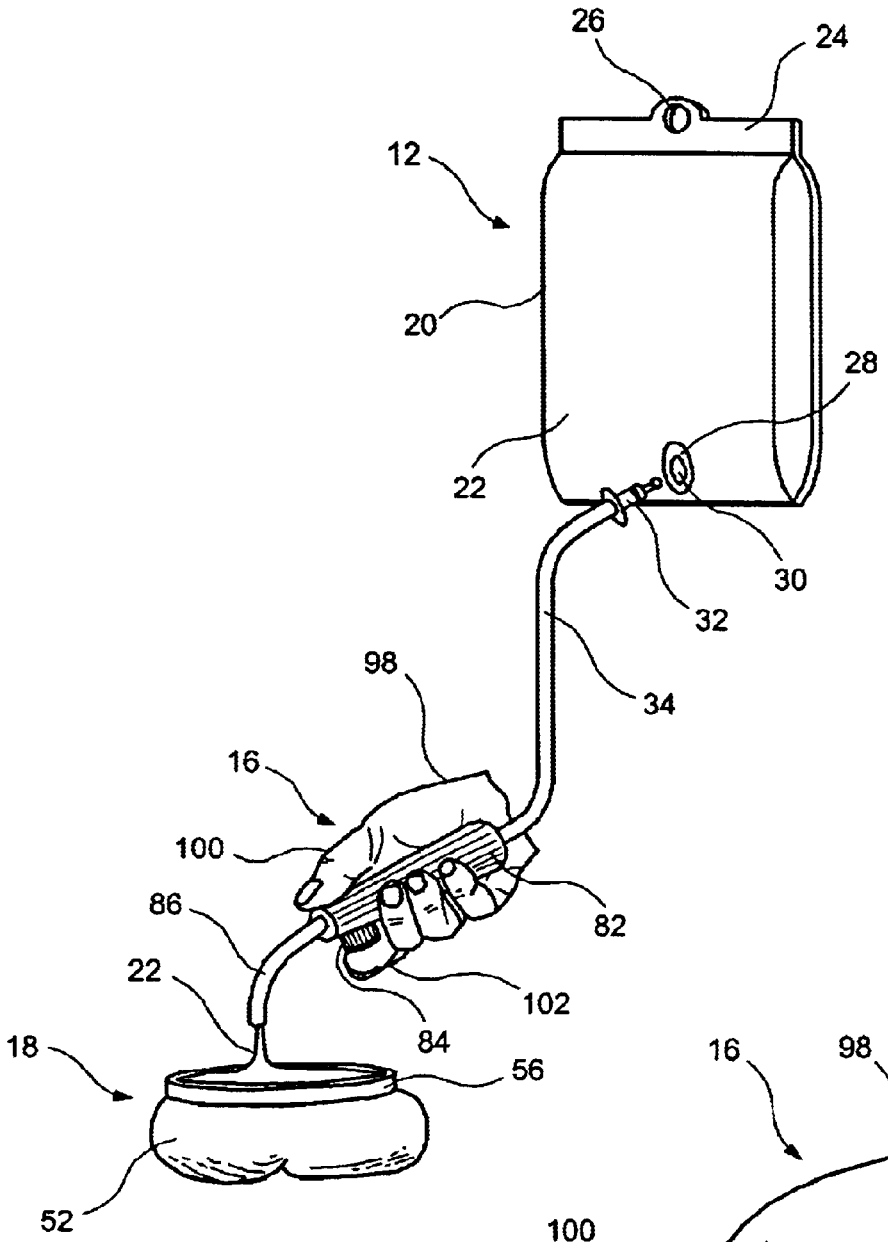
FIGS. 6 and 7 show an embodiment of the invention with a flow regulating handle.

Another example of a fluid dispensing apparatus according to the invention is illustrated in FIG. 6. In this example, the flow regulator 16 has a nozzle 86 attached to a handle 82, which incorporates a depressible flow control button 84 connected to means for stopping the flow of fluid through the tubing. The coupling plug is inserted into the coupling socket 28, as describer above. A portion of the fluid 22 contained in the bag 20 flows into the tubing 34. The flow control button provides a finger pressure activatable device for controlling the fluid flow.

As shown in FIG. 6, the flow regulator handle 82 is grasped by a hand 98 of an operator. The operator's index finger 102 is applied to the button 84, with the operator's thumb 100 positioned against the handle 82 in opposition to the button 84. This facilitating applying sufficient pressure to overcome a biasing force, provided by a spring or other means, which is biased in the direction for halting flow. In other words, the control button is biased into the normally closed position, the pressure from the pincer action of the operators two fingers overcoming the bias, causing the button 84 to be depressed, and so permitting the fluid 22 to issue from the nozzle 86.

In this example, the fluid 22 consists of a condiment such as tomato ketchup, applied to a hamburger patty, by way of example. In its broadest sense, one could consider the bread bun as being the receptacle.

Figure 7:
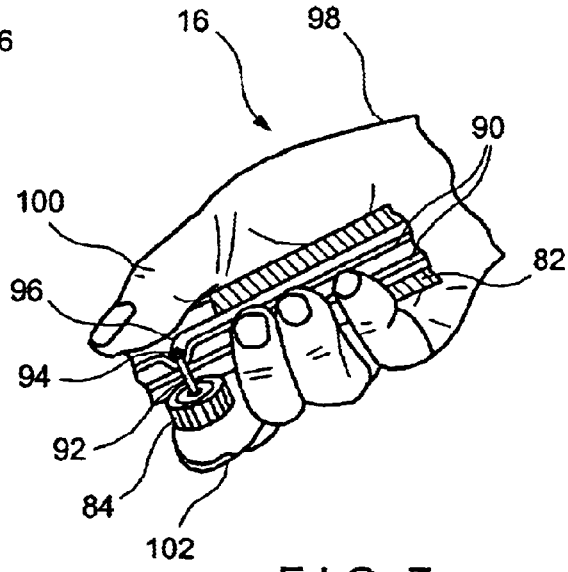

The flow regulator 16 is shown in cross section in FIG. 7, being grasped, as before, by the hand 98. A continuation of the tubing 34 runs through the handle 82 and has a flow path 88 bounded by a cylindrical tubing wall 90. The tubing wall 90 is easily deformable, and is shown pinched through application of localized pressure provided by a pinch roller 94 biased by a pressure spring 96, to squeeze and block the tube 88 and prevent fluid flow. The pinch roller 94 is connected to the button 84 through a suitable linkage 92, so that finger pressure on the button 84 drives the pinch roller 94 away from the tubing wall 90, to open tube 88 to allow fluid flow. Releasing the finger pressure returns the control button to the normally closed position, blocking fluid flow. Flow control and modulation is achieved by varying finger pressure to partially as opposed to fully removing the blockage.

The flow regulator handle as shown in FIG. 6 may be used in the place of the or in addition to the flow regulator 16 shown in FIG. 1. In such a case, the nozzle 86 is partially inserted through the opening 54 so that fluid dispensed from the nozzle 86 is added to the receptacle 56, i.e. adding water manually to the sulfuric acid electrolyte in the battery case.

In yet another example, the receptacle 52 of FIG. 1 forms a part of a laundry apparatus, such as a washing machine having a wash tub. In such an application, the fluid source, the fluid conveying conduit 14 and the flow regulator 16 are generally maintained in a substantially fixed position, while the wash tub and any contents therein are arranged to be rotatable to provide suitable agitation to the contents, to effect a washing action. In this example, the delivered fluid 22 consists of a flowable washing aid which may be in powder form or in liquid form, and which may include water, preferably delivered at the appropriate time in the wash cycle. Preferably, multiple fluid delivery systems are provided, possibly color coded to avoid errors, with one designated for standard laundry soap, another for fabric softener, another for detergent formulated for use with more delicate articles.

Figure 8:
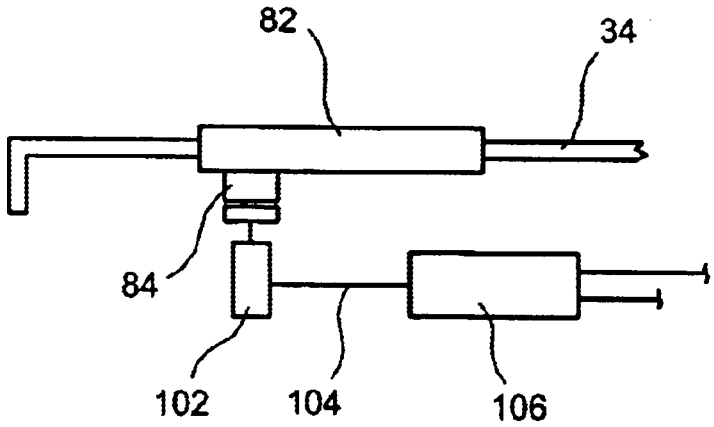
FIG. 8 shows an embodiment of the invention with an automatic flow activator.

In a preferred embodiment, shown in FIG. 8, the flow regulating handle assembly is modified for fixed mounting and is engaged with an actuatable device, such as an electrically operated solenoid 102, which when activated, depresses the button 84 and associated linkage 92, so as to facilitate automated flow control and dispensing of the fluid. For example, a control signal 104 could issue from a microprocessor 106 directing and monitoring a wash cycle, to actuate the solenoid so as to dispense the needed component at the appropriate time and for the appropriate duration to meet the quantity required for that particular wash cycle. The use of the electrically operated solenoid can also be integrated with level sensing and timing mechanisms to coordinate fluid addition more fully with the wash cycle, though of course, other automated flow control arrangements and devices could also be used.

Figure 9:
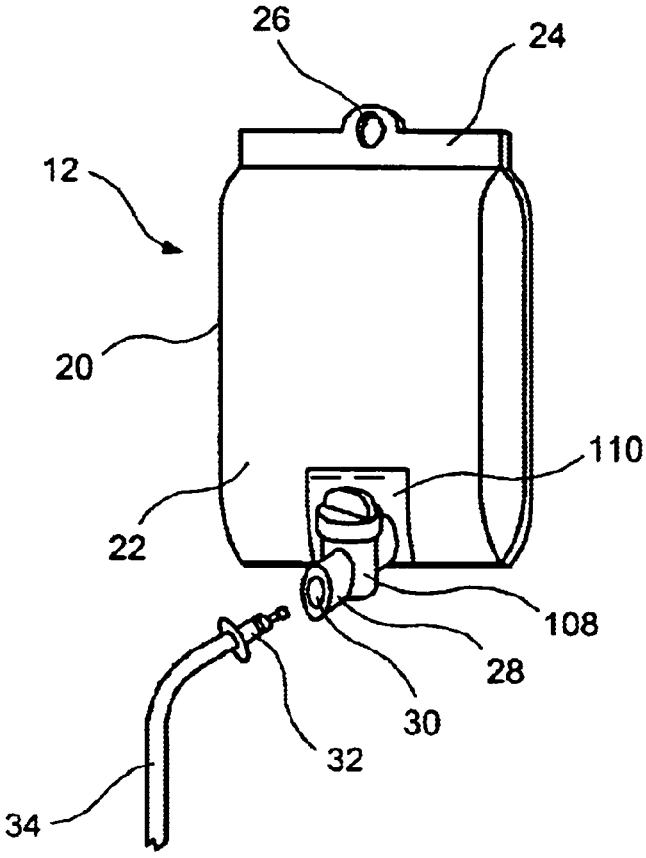
FIG. 9 shows another embodiment of the invention with an on/off valve.

Referring to FIG. 9, another embodiment of the present invention is shown. A flexible bladder or bag 20 has an integral on/off valve 108. The valve has a socket and aperture on a discharge end thereof, so that the plug 32 may be engaged with the socket 28 while the valve is closed.

The valve 108 is located between the bag 20 and a wall of the container 22. The valve 108 thus displaces the socket to the discharge end of the valve. The valve 108 acts as a positive manual shut-off so as to enable and disable any flow from the bag 20, as required. The valve can only allow flow when the plug is seated so that flow may pass through the valve, when that valve is opened, into the tube. This provides a convenient backup to alleviate inadvertent spillage, as a manual shut-off is available as one means of halting flow, as well as pulling the plug from the socket which also halts the fluid flow.

While it may be more convenient to leave the valve open, so as to not impede any flow of the fluid 22, and to rely on the coordination of the coupling mechanism generally according to sequences depicted in FIGS. 2, 3, 4 and 5, the valve 108 may, optionally, be employed operationally so as to enable and to disable flow from the bag 20 into the tubing 34. Accordingly, the coupling mechanism depicted in FIGS. 2, 3, 4 and 5 may be provided without the closure cap 76. It would be advantageous, in this eventuality, to promote requisite coordination between coupling and flow enabling, and uncoupling and flow disabling, by means of an instruction label 110 placed by way of example, near valve 108.

The fluid delivery system 10 is adaptable to convey all flowable materials, possessing a wide range of viscosities or apparent viscosities. In this regard, a low viscosity fluid may be conveyed easily through a narrow bore passage, within a comparatively short period of time, while an extremely viscous fluid may need a wide bore passage, and require a longer time period to completion.

A comparatively low viscosity fluid will likely flow as quickly as to deliver a required quantity of fluid within seconds via a 2 to 15 millimeter bore tube, whereas a high viscosity fluid might require in the region of a 50 millimeter bore tube, and take minutes, even hours and perhaps days, for completion.

Fluids that are part liquid and part solid, for example, tomato ketchup and mayonnaise will, generally, flow, although it can be advantageous to prepare these condiments especially for free flowing by controlling the formulation during manufacture. An increase in temperature can also lead to improved fluid flow.

Certain fluids are so viscous, they will only flow at elevated temperature. It may be feasible to use this characteristic to promote flow and to attenuate flow by suitable application, or withdrawal of heat. It is feasible to provide a flow regulating feature similar in effect to the flow regulator 16 by focusing heat and/or cold at the point of flow regulation.

Powders constituting a wide range of particle sizes are suitable for use in the fluid delivery system of the invention. Sugar, which is coarse, and photocopying toner, which is fine, will both flow. Many powdered materials, such as common washing powder may not necessarily flow properly, and could be subject to aggregation or bridging. In some instances, such powders can be modified to provide free flowing characteristics, typically be altering their surface characteristics, for example, by smoothing or by glazing, or providing a means to fluidize or agitate the material.

The present invention provides many benefits. It allows packaging of diverse components in flexible containers, with reduced spillage and waste. The system is simple and is generally tolerant of human errors, again making it applicable to a broad range of products. Automation is somewhat more complex, but again, enabled fluid delivery with relative precision without human intervention, except to replace a flexible container when empty. The is relatively simple. As the bag is emptied, it is easily exchanged with another, simply by withdrawing the plug from the socket aperture of the empty bag, and inserting the plug 32 into the aperture of a full bag.

While preferred embodiments of the present invention have been shown and described, it will be understood by those skilled in the art that various changes or modifications can be made without varying from the scope of the present invention.

I claim:

1. A system for filling a container comprising a flexible bag containing a dispensable material therein, the bag in fluid communication with a dispensing opening having means for receiving a dispensing conduit therein and reclosable closure means incorporated therewith, which in a first position prevents material flow and in a second position permits material flow, a dispensing coupling for removable placement in the receiving means, the dispensing coupling displacing the reclosable closure means to provide material flow when removably placed therein, the dispensing coupling being connectable to the dispensing conduit, and, a flow regulator for regulating material flow from the flexible bag through the dispensing conduit to the container.

2. The system of claim 1 wherein the receiving means is a socket leading to the dispensing opening.

3. The system of claim 1 wherein the dispensing coupling is received in the receiving means and thereby opens the closure means.

4. The system of claim 1 wherein the flow regulator is a level controlled flow shut-off activator.

5. The system of claim 1 wherein the flow regulator is a manual on/off valve.

6. The system of claim 1 wherein the dispensing conduit is flexible tubing.

7. The system of claim 1 wherein the closure means is an integral push valve, such that receiving the dispensing coupling displaces the push valve in an opening direction to permit material flow.

8. The system of claim 1 wherein the container has a resident material therein prior to receiving the dispensable material.

9. The system of claim 1 wherein the flow regulator has valve means with an electrical actuator.

10. A battery filling system for use in adding fluid to a battery comprising: a flexible bag containing the fluid to be added, the bag in fluid communication with a dispensing opening having means for receiving a dispensing conduit and valve means; a dispensing coupling for removable placement in the receiving means and having an actuator for operating the valve means, and a flow regulator for regulating fluid flow from the flexible bag to the battery through the dispensing conduit, the flow regulator having means to interrupt fluid flow when a desired fluid level is attained in the battery.

11. The battery filling system of claim 10 wherein the valve means is a push valve, the actuator displacing the push valve when received in the dispensing opening to initiate fluid flow.

12. The battery filling system of claim 10 wherein the receiving means is a socket leading to the dispensing opening such that the dispensing coupling is first received by the socket, continued insertion of the coupling causing the actuator to displace the valve means to initiate fluid flow so as to limit fluid leakage.

13. The battery filling system of claim 10 wherein the flow regulator is a level controlled flow shut-off activator.

14. The battery filling system of claim 10 wherein the flow regulator is a manual on/off valve.

15. A method for dispensing materials for delivery to a container comprising:

providing a flexible bag filled with a dispensable material;

providing a dispensing opening on the bag in fluid communication with the means for receiving a dispensing conduit, and having displaceable closure means;

providing a dispensing coupling for placement in the receiving means, the dispensing coupling coupled to the dispensing conduit; providing a flow regulator for regulating flow through the dispensing conduit;

placing a flexible bag in proximity to the container;

locating the flow regulator adjacent a filling opening in the container;

placing the dispensing coupling in the receiving means such that the displaceable closure means is displaced and the dispensable material has access to the dispensing conduit; and using the flow regulator to dispense the material to the container.

* * * * *